US008733064B2

(12) United States Patent
Madison

(10) Patent No.: US 8,733,064 B2
(45) Date of Patent: May 27, 2014

(54) VENTILATION BAFFLE AND INSULATION STOP

(75) Inventor: Kenneth Madison, La Broquerie (CA)

(73) Assignee: Coro-Span Inc., La Broquerie, MB (CA)

( * ) Notice: Subject to any disclaimer, the term of this patent is extended or adjusted under 35 U.S.C. 154(b) by 4 days.

(21) Appl. No.: 13/453,724

(22) Filed: Apr. 23, 2012

(65) Prior Publication Data

US 2013/0276402 A1 Oct. 24, 2013

(51) Int. Cl.
*E04D 13/17* (2006.01)
*F24F 7/02* (2006.01)
*E04D 13/152* (2006.01)

(52) U.S. Cl.
CPC ..... *E04D 13/178* (2013.01); *E04D 13/152* (2013.01); *F24F 7/02* (2013.01)
USPC ..... 52/745.2; 52/95; 52/199; 52/302.1; 454/260

(58) Field of Classification Search
USPC ..... 52/94, 95, 198, 199, 302.1, 302.3, 52/741.4, 745.05, 745.08, 745.19, 745.2; 454/260, 366
See application file for complete search history.

(56) References Cited

U.S. PATENT DOCUMENTS

| | | | | |
|---|---|---|---|---|
| 4,096,790 | A * | 6/1978 | Curran | 454/260 |
| 4,189,878 | A * | 2/1980 | Fitzgerald | 52/95 |
| 4,581,861 | A * | 4/1986 | Eury | 52/95 |
| 5,918,425 | A * | 7/1999 | Archard et al. | 52/95 |
| 6,346,040 | B1 * | 2/2002 | Best | 454/260 |
| 7,856,764 | B2 * | 12/2010 | Kortuem et al. | 52/95 |

* cited by examiner

*Primary Examiner* — William Gilbert
(74) *Attorney, Agent, or Firm* — Adrian D. Battison; Ade & Company Inc.

(57) ABSTRACT

A baffle for use in an attic is installed between adjacent roof rafters to substantially block the flow of ventilating air through an opening located between the top surface of the wall plate and the underside of the roof deck. The baffle is formed from extruded cellular plastics material which is cut to define two parallel grooves by cutting through the first wall to define first and second side flaps hingedly connected to the rectangular panel by bending said sheet at said grooves for attaching the side flaps to the inner face of said roof rafters. The first and second grooves are formed in the sheet at right angles to the webs so that the grooves cut through the first sheet also cut at least partly through the webs.

4 Claims, 7 Drawing Sheets

REAR

VENTILATION BAFFLE AND INSULATION STOP

The present invention relates to a ventilation baffle and insulation stop which is installed between adjacent roof rafters of a house for regulating the flow of ventilating air into and out of the house attic, and for isolating and containing the insulating materials.

BACKGROUND OF THE INVENTION

It is commonplace in the construction of buildings including booth industrial or commercial buildings and residential houses to install batt or particulate insulation between the ceiling joists of the house attic. However, problems may arise if the insulation is installed around the perimeter of the attic between the ceiling joists and the overlying roof deck to such an extent that air vents are blocked. Building codes in most jurisdictions presently require a free flow of ventilating air above the insulating material in order to cool the attic space during the summer months and restrict moisture buildup in the winter.

Soffit or eave vents are currently the most common type of residential attic ventilation. Such vents are intended to provide free flow of air through the opening between the top wall plate of the house and the underside of the roof deck. Ventilating air can circulate into and out of the attic cavity provided that this passageway remains unobstructed.

It is known to provide a cardboard baffle which can be installed between adjacent roof rafters to regulate the flow of ventilating air into and out of the attic.

SUMMARY OF THE INVENTION

In accordance with the invention there is provided method for installing a baffle for use in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the method comprising:

cutting a rectangular panel from a sheet of an extruded cellular plastics material defined by a first wall, a parallel second wall and a plurality of parallel webs separating the first and second walls to create parallel hollow cells along the sheet;

forming first and second parallel grooves in the sheet by cutting through the first wall;

forming first and second side flaps hingedly connected to said rectangular panel by bending said sheet at said grooves for attaching said side flaps to the inner face of said roof rafters; and forming a bottom flap of the rectangular panel hingedly connected to a main part of said rectangular panel by bending the sheet along a fold line transverse to said first and second grooves;

the first and second side flaps extending along side edges of the main part and of the bottom flap of the rectangular panel;

and installing said baffle between adjacent roof rafters by attaching said side flaps to the inner face of said roof rafters to block the flow of ventilating air through said insulating material.

Preferably a V-shaped cut out is formed in the side flaps at the fold line with the apex of the v-shape at the respective groove.

In one embodiment, the fold line is formed at a groove in the sheet formed by cutting through the first wall.

In another preferred arrangement, the first and second grooves are formed in the sheet at right angles to the webs so that the grooves cut through the first sheet also cut at least partly through the webs. This allows the fold line to be formed in the sheet formed by bending the sheet along a cell so that the fold line is parallel to the cells.

Preferably the sheet is transferred to the building with the first and second grooves formed along the sheet to define said side flaps, and, at the building, V-shaped cut outs are formed in the side flaps with the apex of the v-shape at the respective groove with the apexes aligned across the sheet at a required fold line and the fold line is formed by bending the sheet along a cell so that the fold line is parallel to the cells. In this way the installer can choose the dimensions of the bottom flap relative to the main part of the rectangular panel to match required dimensions in the installation.

According to a second aspect of the intention there is provided a baffle for use in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the baffle comprising:

a rectangular panel formed from a sheet of an extruded cellular plastics material defined by a first wall, a parallel second wall and a plurality of parallel webs separating the first and second walls to create parallel hollow cells along the sheet;

first and second parallel grooves cut in the sheet by cutting through the first wall to define first and second side flaps hingedly connected to said rectangular panel by bending said sheet at said grooves for attaching said side flaps to the inner face of said roof rafters.

According to a third aspect of the intention there is provided a baffle for use in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the baffle comprising:

a rectangular panel formed from a sheet of an extruded cellular plastics material defined by a first wall, a parallel second wall and a plurality of parallel webs separating the first and second walls to create parallel hollow cells along the sheet;

first and second parallel grooves cut in the sheet by cutting through the first wall to define first and second side flaps hingedly connected to said rectangular panel by bending said sheet at said grooves for attaching said side flaps to the inner face of said roof rafters;

a third groove in the sheet formed by cutting through the first wall in a direction at right angles to the first and second grooves to define bottom flap of the rectangular panel hingedly connected to a main part of said rectangular panel by bending the sheet along a fold line transverse to said first and second grooves;

a V-shaped cut out in each of the side flaps at the fold line with the apex of the v-shape at the respective groove.

According to a fourth aspect of the intention there is provided a baffle for use in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the baffle comprising:

a rectangular panel formed from a sheet of an extruded cellular plastics material defined by a first wall, a parallel second wall and a plurality of parallel webs separating the first and second walls to create parallel hollow cells along the sheet;

first and second parallel grooves cut in the sheet by cutting through the first wall to define first and second side flaps hingedly connected to said rectangular panel by bending said sheet at said grooves for attaching said side flaps to the inner face of said roof rafters;

wherein the first and second grooves are formed in the sheet at right angles to the webs so that the grooves cut through the first sheet also cut at least partly through the webs.

SUMMARY OF THE INVENTION

It is one object of the invention to provide a.

According to one aspect of the invention there is provided a

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

The present invention is directed to a baffle which is installed between adjacent roof rafters of a house or other building. The baffle acts as a rigid barrier separating ventilating air and the attic insulation. The baffle acts as a complete barrier to the flow of air through the opening located between the top wall plate of the house and the underside of the roofing boards.

Figure 1:
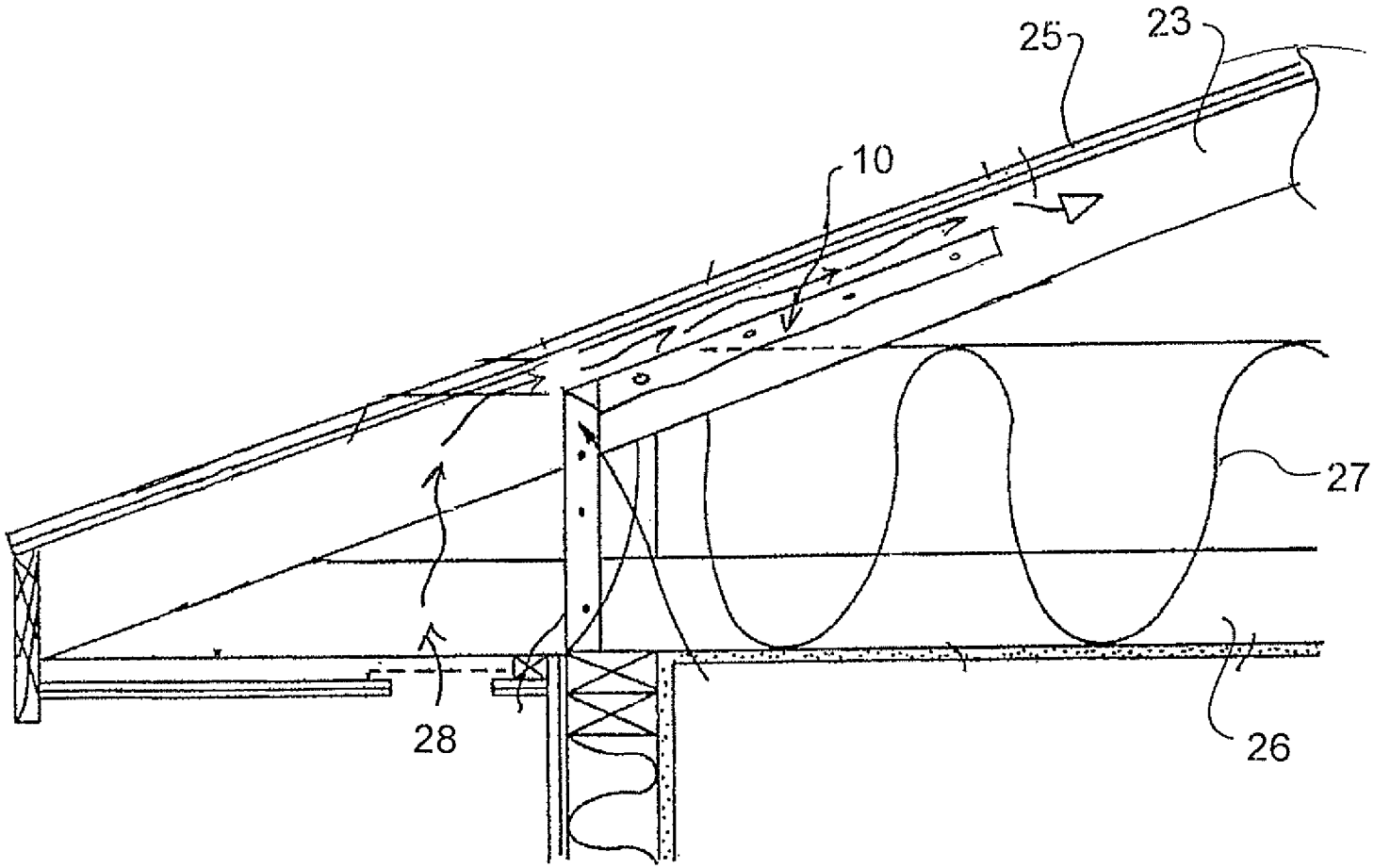
FIG. 1 is a vertical cross-section through a building including an installed baffle.
Figure 2:
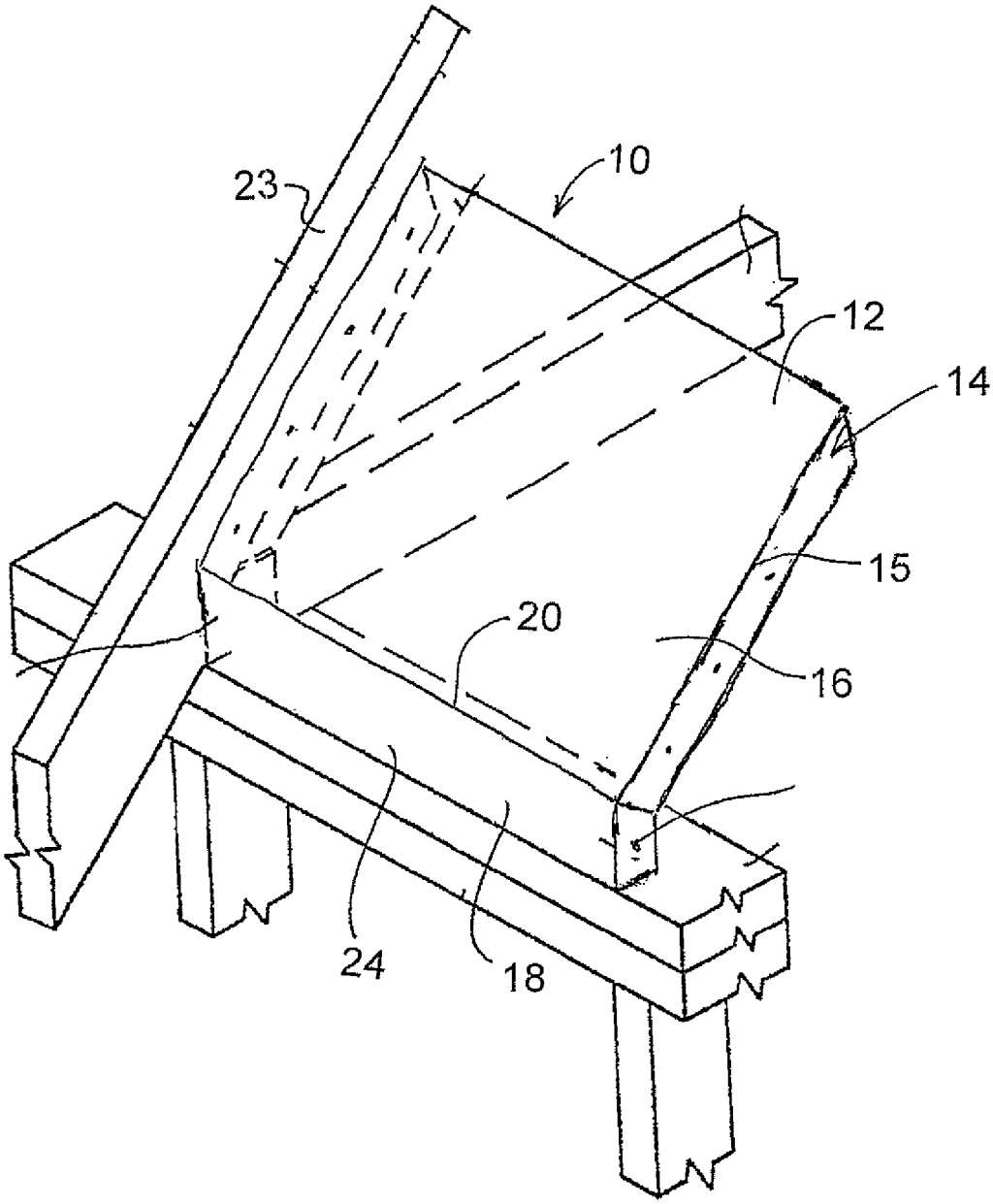
FIG. 2 is an isometric view of part of the components showing the construction of the baffle.

With reference to FIG. 1, a baffle 10 is shown in plan view in its flat condition prior to installation. Each baffle 10 includes a generally rectangular panel 12 having side flaps 14 hingedly connected at opposed sides of panel 12 along its side edges. The joints between side flaps 14 and panel 12 are defined by grooves 15.

Baffle 10 also has a main body 16 hingedly connected to a bottom flap 18 hingedly connected along the bottom edge of the main body 16 panel 12. The joints between the flap 18 and the main body 16 of the panel 12 are defined by a fold line 20.

The baffle 10 is installed between adjacent roof rafters 23 which extend parallel to one another from the top plate 24 of the house wall to the apex of the roof. A roof deck 25 is usually nailed on top of roof rafters 30 and a suitable covering, such as shakes or shingles, is fastened on top of the roof deck.

The attic ceiling joists 26 are also connected to rafters 23 and top plate 24. Insulating material 27 is typically installed between and above attic ceiling joists 26 in order to reduce heat loss from the house.

An opening 28 is defined between the top plate 24 of the house wall and the overlying rafters 23 and roof deck 25 which permits the flow of ventilating air between the soffit or eave area of the house and the interior of the attic.

In use, the baffle 10 is installed by folding bottom flap 18 downwardly to a position at an angle to the main body 16 of the panel 12. Opposed side flaps 14 of the main body and the flap 18 are folded inwardly to a position normal to the panel 12 and fastened with tacks to the inner surface of adjacent rafters 23.

In most residential houses rafters 23 are typically placed a standard distance apart so that the width of the main body is pre-determined. Typically in residential buildings the rafters are located at 24 inch spacing and in commercial buildings the rafters are at 48 inch spacing so that baffles can be manufactured to match these requirements.

Figure 3:
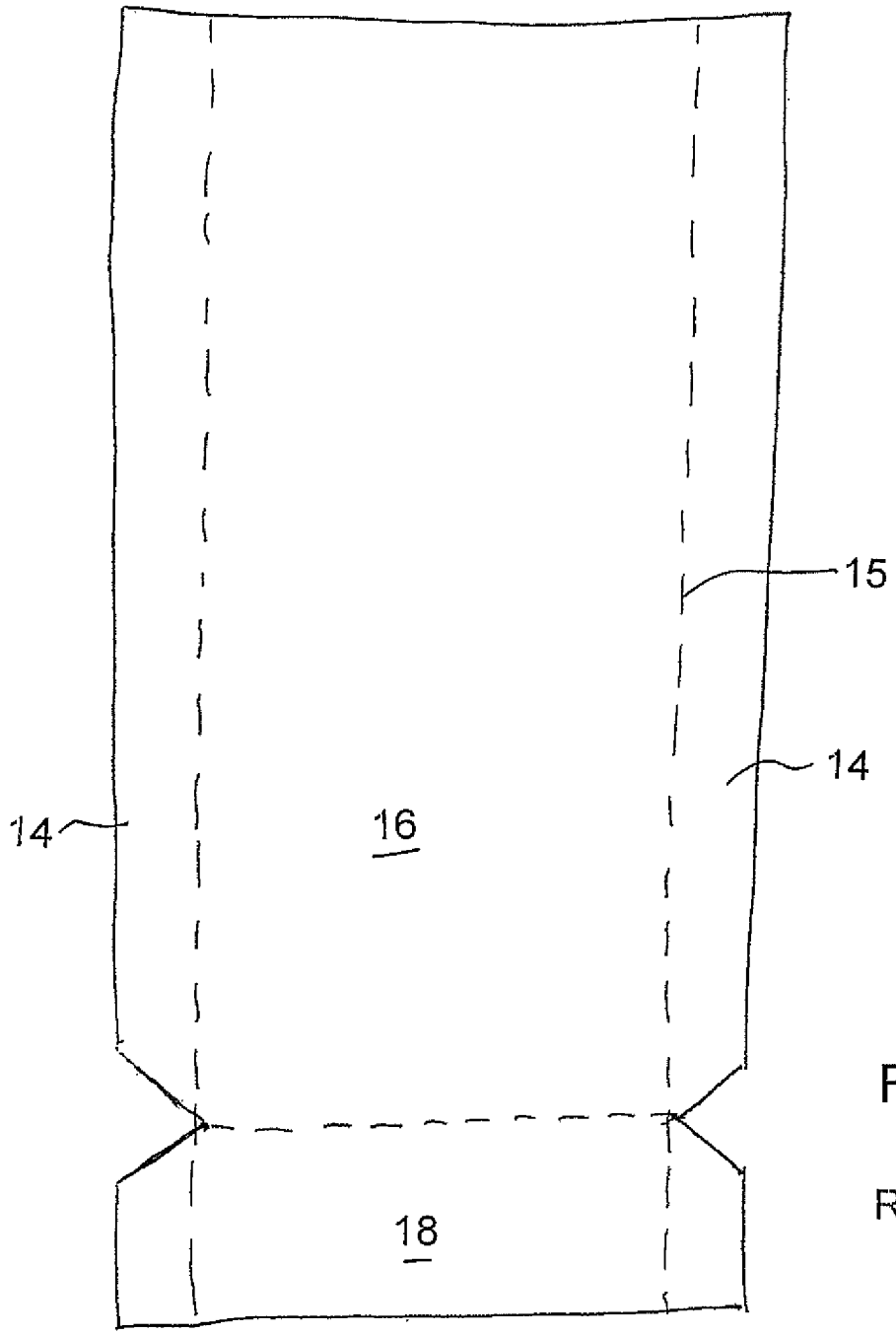
FIG. 3 is a plan view of the blank of the baffle immediately prior to installation.
Figure 4:
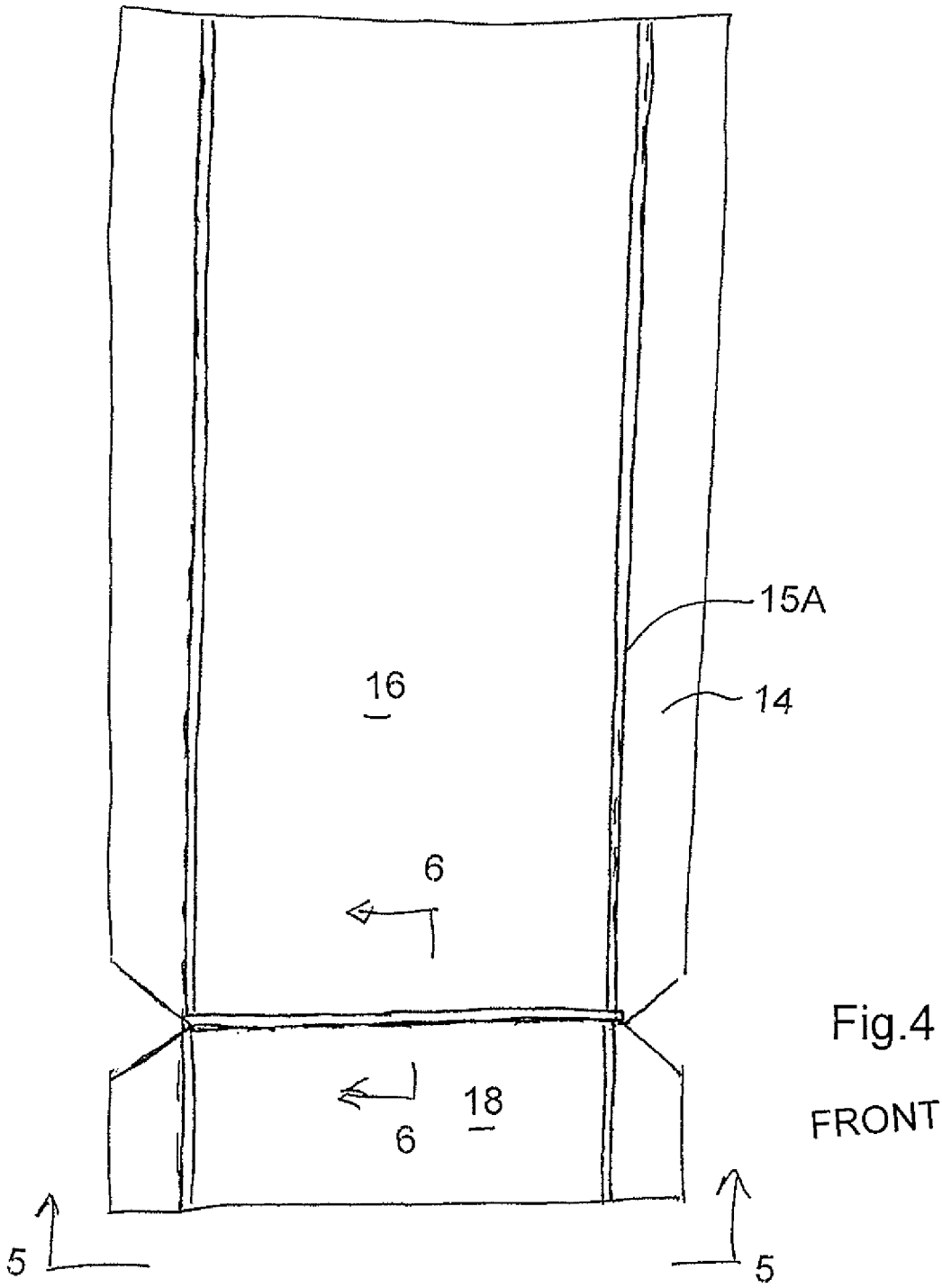
FIG. 4 shows a plan view of one embodiment of baffle.
Figure 7:
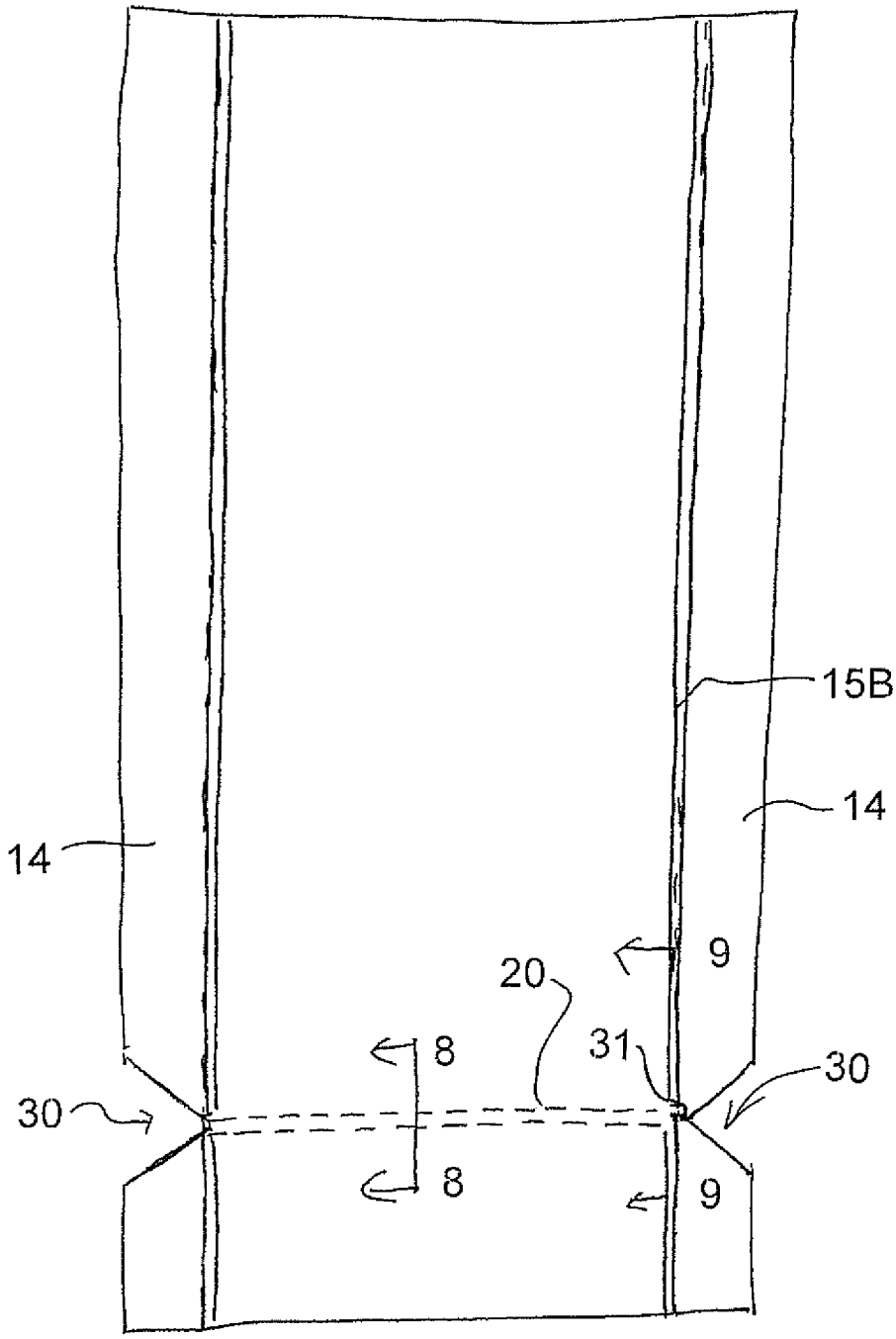
FIG. 7 shows a plan view of one embodiment of baffle.

As shown in FIGS. 3, 4 and 7 the baffle 10 is formed by cutting a rectangular panel from a sheet of an extruded cellular plastics material.

As shown in FIGS. 5, 6, 8 and 9 the extruded plastics material is of the type defined by a first wall 10A, a parallel second wall 10B and a plurality of parallel webs 10C separating the first and second walls to create parallel hollow cells 10D along the sheet. Material of this type is typically called Coroplast and sold under that trademark.

In the method the sheet is cut to form the main panel 16 and the side flaps 14 by forming first and second parallel grooves 15A in the sheet by cutting through the first wall.

Figure 5:
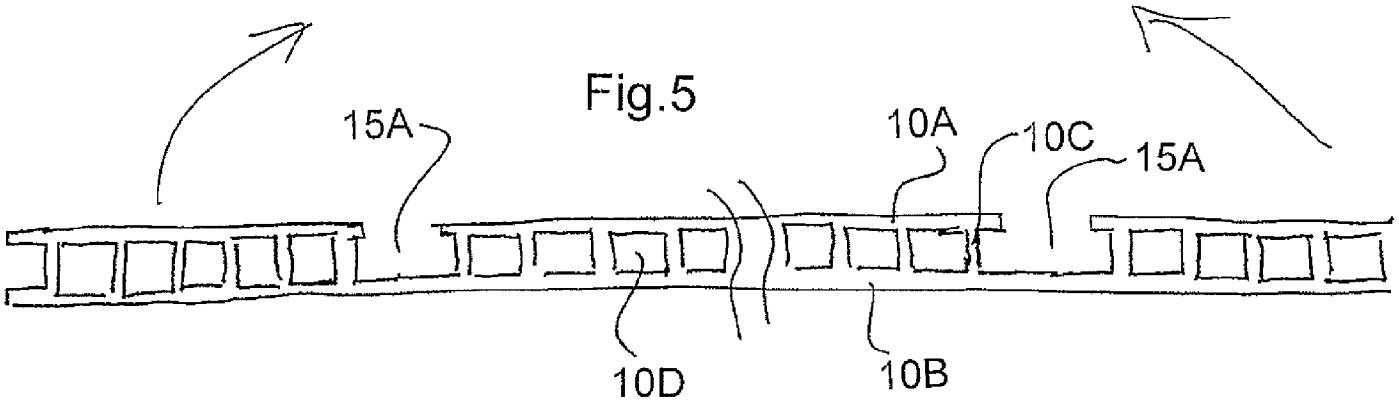
FIGS. 5 and 6 show cross-sectional views along the lines 5-5 and 6-6 of the embodiment of baffle of FIG. 4.
Figure 6:
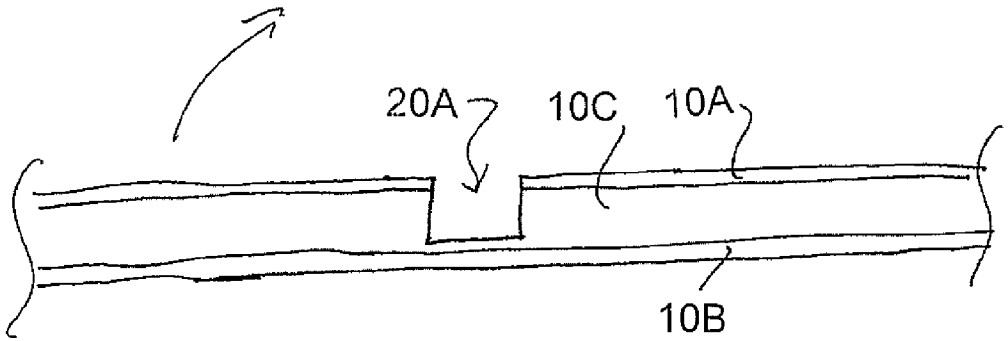

In the embodiment of FIGS. 4, 5 and 6, the grooves 15A are cut in the direction parallel to the cells 10D so that the cutting typically cuts the top wall 10A and one of the webs 10C. In this embodiment, a further groove 20A is cut at the fold line 20 in a direction at right angles to the cells 10D.

Figure 8:
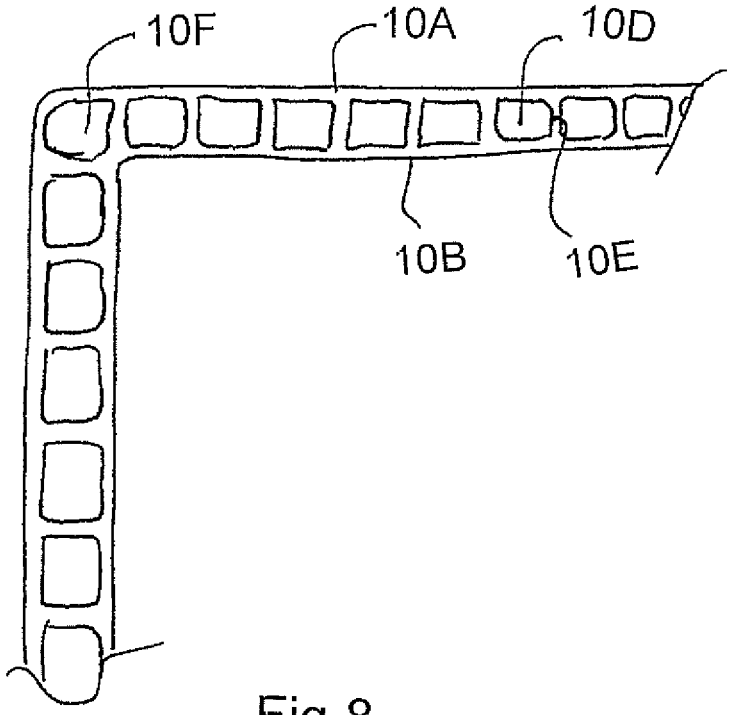
FIGS. 8 and 9 show cross-sectional views along the lines 8-8 and 9-9 of the embodiment of baffle of FIG. 7.
Figure 9:
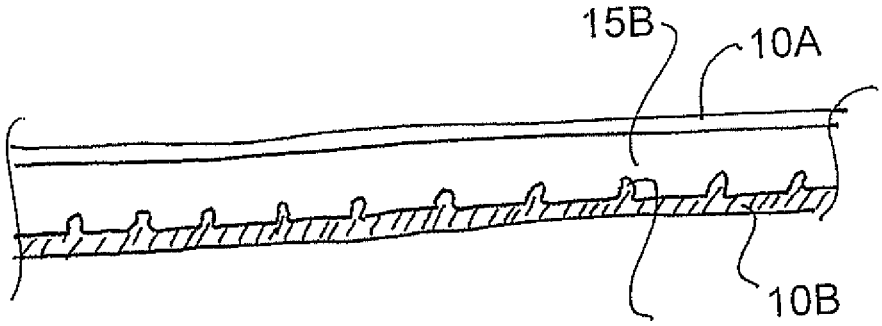

In the embodiment of FIGS. 7, 8 and 9, the grooves 15B are cut in the direction at right angles to the cells 10D so that the cutting typically cuts the top wall 10A and across the webs 10C so as to cut the webs 10C down close to the bottom wall 10B as indicated at 10E. In this embodiment, a the fold line 20 is formed in a direction along one of the cells 10D by deforming one or more cells in a bending action as shown at 10F.

In installation, the first and second side flaps hingedly connected to said rectangular panel are formed by bending said sheet at the grooves 15 with the wall 10B outermost for attaching the side flaps to the inner face of said roof rafters.

In installation the bottom flap 18 of the rectangular panel hingedly connected to the main part 16 is formed by bending the sheet along the fold line transverse 20 to said first and second grooves.

The baffle is inserted between adjacent roof rafters by attaching said side flaps 14 to the inner face of said roof rafters 23 to block the flow of ventilating air through said insulating material.

In order to allow bending of the side flaps at the fold line 20, a V-shaped cut out 30 is formed in the side flaps 14 at the fold line 20 with the apex 31 of the v-shape at the respective groove 15.

In the embodiment of FIG. 4, the fold line 20 is formed at a groove 20A in the sheet formed by cutting through the first wall.

In the embodiment of FIG. 7, the first and second grooves 15B are formed in the sheet at right angles to the webs so that the grooves cut through the first sheet also cut at least partly through the webs. In this case the fold line 20 is formed in the sheet formed by bending the sheet along a cell 10F so that the fold line is parallel to the cells.

In a preferred installation method the sheet of FIG. 7 is transferred to the building with the first and second grooves formed along the sheet to define said side flaps.

When supplied, the cut outs 30 are not formed and the fold line 20 is not formed so that the installer, at the building, uses suitable cutting tools to cut the V-shaped cut outs 30 in the side flaps at the selected location depending on the dimension of the building and the fold line is formed by bending the sheet along a cell between the apexes 31 so that the fold line is parallel to the cells and is defined or located on the sheet by the weakness applied by the V-shaped cut outs.

The invention claimed is:

1. A method for installing a baffle in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the method comprising:

supplying to the building a rectangular panel from a sheet of an extruded cellular plastics material defined by a first upper wall, a parallel second lower wall and a plurality of parallel webs separating the first and second walls to create parallel hollow cells along the panel, the panel having first and second side edges, a top edge and a bottom edge;

forming first and second parallel grooves in the sheet by cutting through the first upper wall at positions adjacent the respective first and second side edges of the panel;

forming first and second side flaps of the panel by bending downwardly said first and second side edges of said panel respectively at said first and second grooves;

forming a first V-shaped cut-out in the first side flap with an apex of the first V-shaped cut out being located at the first groove and with sides of the first V-shaped cut out diverging outwardly from the apex at the first groove to intersect the first side edge;

forming a second V-shaped cut-out in the second side flap with an apex of the second V-shaped cut out being located at the second groove and with sides of the second V-shaped cut out diverging outwardly from the apex at the second groove to intersect the second side edge;

forming a bottom flap of the panel by bending downwardly the bottom edge of the panel along a fold line, where the fold line extends at right angles to said first and second grooves and joins said apexes of the said first and second cut-outs;

installing said baffle between adjacent roof rafters by locating said panel between said roof rafters with said bottom edge engaging the top wall plate and with said first and second side flaps extending downwardly along the roof rafters so that the first and second side edges are spaced downwardly from the roof covering;

and attaching said first and second side flaps to respective inner faces of said roof rafters to block the flow of ventilating air through said insulating material.

2. The method according to claim 1 wherein the first and second grooves are formed in the panel at right angles to the webs so that the first and second grooves cut through the first wall also cut at least partly through the webs.

3. The method according to claim 2 wherein the fold line is parallel to the cells.

4. A method for installing a baffle in a building having an attic defined by:

a vertical exterior wall having a horizontal top wall plate;

parallel floor joists supported by said top wall plate; and spaced apart, inclined roof rafters securely connected to said top wall plate and said floor joists, said roof rafters having a roof covering fastened on their upper surface;

said attic having a vent around its outer periphery between said top wall plate and the underside of said roof covering enabling the flow of ventilating air between an exterior soffit and insulating material installed between said floor joists in the interior of said attic, the method comprising:

supplying to the building a rectangular panel from a sheet of an extruded cellular plastics material defined by a first upper wall, a parallel second lower wall and a plurality of parallel webs separating the first and second walls to create parallel hollow cells along the panel, the panel having first and second side edges, a top edge and a bottom edge;

forming first and second parallel grooves in the sheet by cutting through the first upper wall at positions adjacent the respective first and second side edges of the panel;

forming first and second side flaps of the panel by bending downwardly said first and second side edges of said panel respectively at said first and second grooves;

forming at the building a first V-shaped cut-out in the first side flap with an apex of the first V-shaped cut out being located at the first groove and with sides of the first V-shaped cut out diverging outwardly from the apex at the first groove to intersect the first side edge;

forming at the building a second V-shaped cut-out in the second side flap with an apex of the second V-shaped cut out being located at the second groove and with sides of the second V-shaped cut out diverging outwardly from the apex at the second groove to intersect the second side edge;

forming a bottom flap of the panel by bending downwardly the bottom edge of the panel along a fold line where the fold line is at right angles to said first and second grooves and joins said apexes of the said first and second cut-outs;

the first and second cut-outs being formed at the building and spaced from the bottom edge by a distance which depends on the dimensions of the building;

installing said baffle between adjacent roof rafters by locating said panel between said roof rafters with said bottom edge engaging the top wall plate and with said first and second side flaps extending downwardly along the roof rafters so that the first and second side edges are spaced downwardly from the roof covering;

and attaching said first and second side flaps to respective inner faces of said roof rafters to block the flow of ventilating air through said insulating material.

* * * * *